United States Patent [19]

Limb et al.

[11] Patent Number: 4,961,238

[45] **Date of Patent: * Oct. 9, 1990**

[54] INSULATING COVERLET FOR CONVENTIONAL WATERBEDS

[76] Inventors: Garth J. Limb; Sandra L. Limb, both of 7156 S. 1115 West, West Jordan, Utah 84084

[ * ] Notice: The portion of the term of this patent subsequent to Jul. 5, 2005 has been disclaimed.

[21] Appl. No.: 214,337

[22] Filed: Jul. 1, 1988

Related U.S. Application Data

[63] Continuation-in-part of Ser. No. 94,038, Aug. 31, 1987, Pat. No. 4,754,514, which is a continuation of Ser. No. 846,131, Mar. 31, 1986, abandoned.

[51] Int. Cl.[5] ..... E04H 3/19; B32B 3/02; B32B 5/02; B32B 5/18

[52] U.S. Cl. ..... 5/500; 5/502; 428/71; 428/76; 428/81; 428/156; 428/215; 428/287; 428/297; 428/298; 428/316.6; 428/398

[58] Field of Search ..... 5/451, 482, 500, 502; 428/71, 76, 81, 156, 215, 287, 297, 298, 316.6, 398

[56] References Cited

U.S. PATENT DOCUMENTS

| | | | |
|---|---|---|---|
| 2,087,505 | 7/1937 | Davis | 5/502 |
| 3,242,508 | 3/1966 | Smithson | 5/502 |
| 3,405,674 | 10/1968 | Coates et al. | 5/502 |
| 3,467,974 | 9/1969 | Deutsch | 5/502 |
| 3,485,711 | 12/1969 | Fish, Jr. et al. | 428/376 |
| 3,900,648 | 8/1975 | Smith | 428/317.9 |
| 4,269,889 | 5/1981 | Takagi | 428/311.1 |
| 4,395,455 | 7/1983 | Frankosky | 428/398 |
| 4,499,133 | 2/1985 | Prince | 428/81 |
| 4,514,455 | 4/1985 | Hwang | 428/398 |
| 4,569,874 | 2/1986 | Kuznetz | 428/398 |
| 4,608,298 | 8/1986 | Klaff | 428/316.6 |
| 4,754,514 | 7/1988 | Limb et al. | 428/316.6 |

FOREIGN PATENT DOCUMENTS

| | | | |
|---|---|---|---|
| 1069622 | 1/1980 | Canada | 5/500 |

*Primary Examiner*—William J. Van Balen
*Attorney, Agent, or Firm*—Trask, Britt & Rossa

[57] ABSTRACT

A coverlet for conventional, unheated waterbeds which provides effective insulation is disclosed. The coverlet utilizes an insulating layer of fibrous materials, such as hollow polyester fibers, typically quilted together with a layer of flexible, lightweight foam material.

7 Claims, 2 Drawing Sheets

INSULATING COVERLET FOR CONVENTIONAL WATERBEDS

RELATED APPLICATIONS

This application is a continuation-in-part of application Ser. No. 094,038, filed Aug. 31, 1987, now U.S. Pat. No. 4,754,514 dated July 5, 1988 which was a continuation of Ser. No. 846,131, filed Mar. 31, 1986, now abandoned.

BACKGROUND OF THE INVENTION

1. Field

The present invention relates to insulating pads for waterbeds and particularly to an insulating pad for an unheated waterbed bladder.

2. Prior Art

It is well known, as indicated in U.S. Pat. No. 4,549,323 to Brockhaus that unheated conventional waterbeds are very uncomfortable for sleeping purposes. In fact, at room temperatures of about 65 to 75 degrees the difference between the body's normal temperature of about 98 degrees and water in the large waterbed bladder will preclude a restful night's sleep. Because of this fact, it is common practice for many owners of waterbeds to leave the bladder heater on twenty-four hours per day.

An evolution which has occurred to overcome the problem associated with great weight and the large volume of cool water present in conventional waterbed bladders is the development of the hybrid waterbed mattresses. A hybrid waterbed mattress is illustrated in U.S. Pat. No. 4,186,455 to Fox et al. and in many of the patents recited in that patent.

A hybrid waterbed mattress generally has a bladder of about four to six inches in depth and has less width and length than a conventional waterbed bladder, resulting in much less water being present in the hybrid mattresses. In a hybrid waterbed mattress there is generally no heater and the person sleeping on the hybrid waterbed mattress is insulated by a foam pad and a conventional quilted cover having a small quantity of cotton or fiberfill material therein. Because of the smaller amount of water present, e.g. about 40% as much as in a conventional waterbed, and the presence of an insulating foam pad, it is possible that the amount of heat escaping a person sleeping upon the hybrid waterbed mattress can warm the water sufficiently so that a comfortable night's sleep might be obtained. Also, because of the insulating foam pad over the hybrid waterbed mattress, there is not a significant amount of heat transferred from the sleeper to the water. A typical cover for hybrid mattresses is illustrated in U.S. Pat. No. 4,316,423 of Nordstrom.

Other attempts to solve the problem with the respect to large conventional waterbed bladders are recited U.S. Pat. No. 4,549,323.

The insulating pad described as the invention of U.S. Pat. No. 4,549,323 is very complex in nature and comprises a number of layers to provide an insulating coverlet for use with a conventional waterbed bladder. While the insulating cover of the 4,549,323 patent may be effective, it comprises a great number of layers of relatively sophisticated materials. Some of the layers are a plastic sheet material containing air pockets or bubbles, which are deemed to be susceptible to wear, resulting in the bubbles being popped and that layer losing its insulating qualities. Furthermore, it is generally not comfortable to sleep upon a plastic sheet material.

Very thick foam pads have been utilized to provide a measure of insulation on the top surface of a hybrid waterbed. A construction is shown in U.S. Pat. No. 4,221,013 wherein two foam layers are used to provide insulation above a plurality of small tubular bladders having a total water content which is only a small fraction of that of a conventional waterbed bladder. Foam, however, tends to compress significantly under load. Also, foam even under a fabric ticking has a feel which many find unacceptable. A foam layer over a water bladder is also illustrated in the hybrid waterbed disclosed in U.S. Pat. No. 4,187,566 of Peterson.

Hybrid waterbed mattresses have become popular because a heater is generally not required and the mattress has the size and appearance of a regular innerspring mattress, as well as greatly reduced weight. The modest amount of insulation required to insulate a sleeper from the smaller volume of water present generally precludes the necessity of a heater. Thus, foam insulation of a few inches in thickness has generally been satisfactory for hybrid waterbed mattresses.

Further efforts to construct a useful insulating coverlet for a conventional waterbed mattress have included a combination of carpet backing, that is, spongy carpet pad material with an overlay of flexible polyurethane foam or a thin layer of conventional Dacron fiberfill material quilted to the carpet backing. While such constructions are relatively inexpensive to make and can be made from readily available materials, such a coverlet is stiff and generally ineffective, and is relatively heavy, hard and very difficult to quilt.

SUMMARY OF THE INVENTION

The instant invention relates to a bladder cover for a conventional unheated waterbed bladder in which an insulating layer of hollow fibers, particularly of hollow polyester fibers, is present in a sufficient thickness to provide a lightweight cover with a sufficiently insulating layer to insulate a sleeper from the cool water contained in a conventional waterbed bladder.

The insulating layer of hollow fibers may be quilted in a conventional manner with a fabric overlay, which is preferably decorative, and a fabric underlay to form a coverlet, or it may be quilted to an underlayer of flexible urethane foam sheet or slab material, i.e., a unitary piece of foam, with an overlayer of conventional fabric material. The fabric overlay and underlay materials are frequently referred to in the bedding industry as ticking. A light weight, easily constructed coverlet is formed which does not interfere with the sleeping qualities of a waterbed and which effectively insulates a sleeper from a large body of unheated water within the bladder of the waterbed.

DETAILED DESCRIPTION OF THE INVENTION

The instant invention provides a bladder cover or coverlet for a conventional unheated waterbed bladder. The coverlet is sufficiently thin in its thickness that it may be readily quilted and yet provide outstanding insulation properties so that a person sleeping on a conventional unheated waterbed bladder with such a coverlet may sleep comfortably without the comfort of the water support being interfered with and yet without an undue loss of the heat from the sleeper to the water within the bladder.

The invention comprises a layer of insulating fibers from particular hollow polyester fibers known in the trade as "Hollofil" or "Quallofil." Hollofil is a duPont trademark for a series of insulating, lightweight, hollow, polyester fibers used extensively in top quality sleeping bags, parka's and other products in which insulation qualities are required without the burden of large volume and weight of material although the materials retain an effective bulk and insulation quality under load.

Another particularly useful hollow fiber material is a duPont product identified as "Corebond" wherein at least a pair of fibers are formed or bonded in a "V" shape to provide an insulating fiber with a higher loft. The greater loft provides greater insulation and comfort, permitting less fiberfill to be used in conjunction with a foam base, which may then be thicker to reduce wave effect, or Corebond may be used alone without a foam base.

U.S. Pat. No. 3,772,137 assigned to E. I. duPont de Nemours and Company describes crimped hollow polyester filaments and batts of the type useful as insulating fill material in the instant invention, the content of that patent being incorporated herein by reference. Other types of hollow fibers may be utilized, e.g., hollow glass fibers; however, hollow, organic, polyester lightweight, flexible fibers are preferred.

Figure 1:
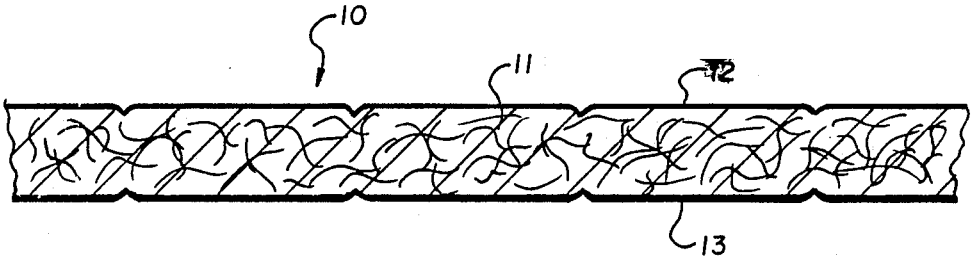
FIG. 1 is a cross-sectional elevational view of a coverlet of the instant invention.

Further description of the invention may be facilitated by reference to the attached drawings. In FIG. 1 a cross-sectional elevational view of a coverlet of the instant invention is illustrated wherein a coverlet 10 has an insulating body 11 of either loose or matted, hollow fibers. The coverlet typically has a width of from about 38 inches to about 78 inches and a length of about 84 inches to about 88 inches. Popular waterbeds range in width from about 40 inches to about 74 inches while lengths are about 86 inches. The insulated fiber body 11 is quilted between an outer fabric 12 and an other fabric 13. Fabric 12 may be a conventional rayon, nylon, polyester or cotton material, usually decorative, of the type used for mattress covers e.g., ticking. Fabric 13 may be similar to the fabric 12 material having sufficient strength and thickness to provide a long-wearing surface for the underbody of the coverlet. Fabric 13 is preferably a non-slip fabric material. Fabric 13 may not be decorative. In certain instances it is desirable that fabric 13 be the same as fabric 12, e.g., decorative so that the coverlet is reversible.

The hollow fiberfill material 11 in a coverlet having no other insulating materials present is generally of a thickness of at least about one-half inch and preferably about two inches in thickness. If such a coverlet is more than three and a half inches in thickness, preferably about two and one-half inches, then its bulk is such that much of the water-support effect of the waterbed mattress is diminished. A preferable maximum thickness is about two and one-half inches.

Figure 2:
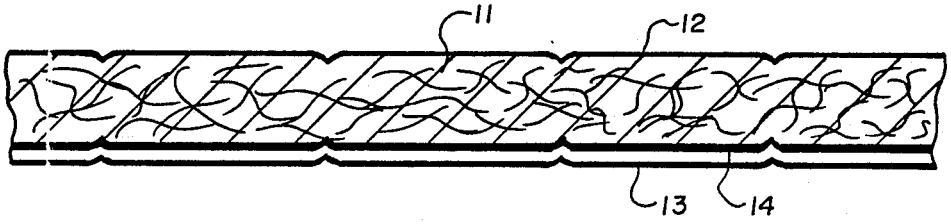
FIG. 2 is a cross-sectional elevational view of a modified coverlet of the instant invention.

In FIG. 2, a modified coverlet is illustrated wherein the coverlet is constructed of a body 11 of hollow fibers, an upper fabric material 12 and a lower fabric material 13 with a heat reflective sheet 14 of heat reflective material interposed underneath the hollow fiber layer. The heat reflective material 14 may be a thin sheet of aluminum foil or a sheet of flexible plastic material which has been aluminized. A sheet of material such as that commonly known as "space blankets" is effective for this purpose.

While the presence of a heat reflective layer may improve the insulating character of the coverlet, it may diminish the washability of the coverlet.

Figure 3:
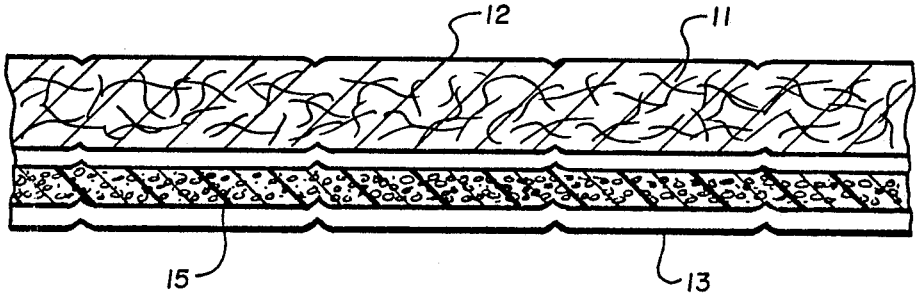
FIG. 3 is a cross-sectional elevational view of a coverlet of the instant invention modified with a basis layer of flexible insulating foam material.

In FIG. 3, a preferred construction is illustrated wherein the hollow fiber material 11, the upper fabric 12 and the lower fabric 13 and a foam pad 15 are formed in a quilted, sandwich construction. In the construction illustrated in FIG. 3 the hollow fiber layer, generally present as a batt, is generally present from about one-half inch up to about one and one-half inches in thickness, while the foam pad or slab is present from about three eights inch up to about two inches in thickness, although a maximum thickness is preferably about one and one-half inches.

The foam material in the construction of FIG. 3 is preferably a flexible, very lightweight material having good insulating properties. Polyurethane is a preferred foam; however, rubber latex foam and other foams may be utilized.

In the coverlet construction illustrated in FIG. 3, the foam layer is preferably present from about three-fourths to about one inch in thickness and the hollow fiber layer is preferably three-eighths to about three-fourths inch, although a greater amount of insulating fibers can be effectively used. Such a construction is sufficiently flexible and thin that the comfort of the water mattress is not substantially diminished while excellent insulation is provided.

A construction having a foam thickness approaching two inches generally requires less of the hollow fiberfill insulation. For example, a foam layer of two inches may be joined with a one-half inch layer of hollow fiber, especially Corebond fibers, to maintain an overall thickness that is not greater than two and one-half inches, although a thickness up to three and one-half inches may be utilized. Such a construction may be desirable in colder climates as well as effectively dampening undue wave motion from a large water bladder which is without internal dampening means. One effective foam layer useful in thicker constructions is the convoluted or "egg carton" foam frequently used in hospital beds.

Wave reduction in conventional waterbed bladders has been a concern in the industry. Baffles within the bladders have been utilized as well as foam pads within the bladder, including the improved techniques illustrated in U.S. Pat. Nos. 4,496,623; 4,301,580 and 3,957,557.

A three layer coverlet maybe made from the type illustrated in FIG. 3 by the addition of an insulating layer of fibers under the foam layer. Such a three-layer sandwich construction is completely reversible when the underlay fabric is also decorative.

Figure 4:
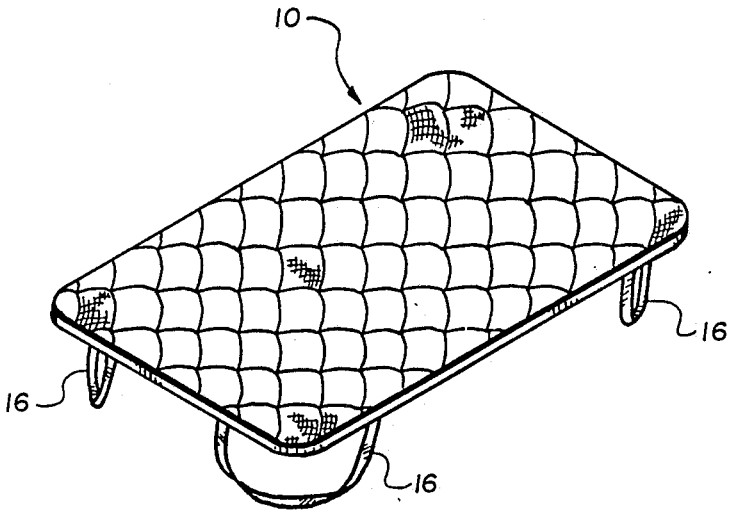
FIG. 4 is a perspective view of the coverlet of the instant invention illustrating attachment means to attach the coverlet to a conventional waterbed.

Another view of the coverlet of the instant invention is provided in the perspective view in FIG. 4. The coverlet 10 is shown with loop straps 16 attached adjacent each corner so that the coverlet may be fitted to the water mattress in a secure fashion so that it does not slip out unduly. The straps 16 may be placed about and under the corners of a conventional waterbed bladder. The loop formed by each strap 16 should be sufficiently large to allow the loop to fit around and under a corner of a filled waterbed bladder. Each end of a strap may be permanently fixed to the coverlet or one end may be fixed with Velcro.

Other means may be provided for securing the coverlet 10 over a waterbed mattress so that it does not slip about. For example, the coverlet may be provided with a skirt of material about the perimeter of the coverlet. The depending skirt may then be tucked in along the sides of the waterbed between the wooden side wall and the bladder to a sufficient depth so that the weight of sleepers on the bed forces the bladder against the wooden side walls with such force that the trapped skirt would not permit the coverlet to slide about. Also, cups or pockets of fabric may be secured to each corner of the coverlet so that the cup or pocket is sized to encompass a corner of a filled waterbed bladder. These cups or pockets function similarly to loops.

Figure 5:
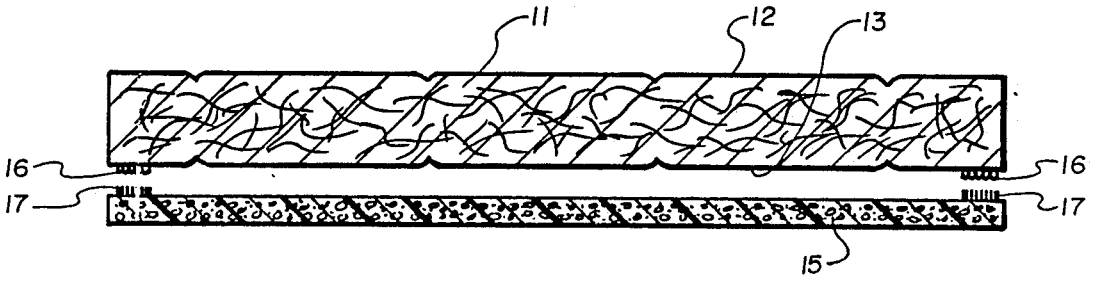
FIG. 5 is a cross-sectional elevational view of a coverlet of the instant invention showing temporary attachment means for a foam layer.

Another construction of a coverlet of the instant invention is illustrated in FIG. 5. A coverlet of the type illustrated in FIG. 1 having an inner-layer of hollow fiber material, a decorative cover 12 and an under fabric 13 is quilted together to form an integral unit. About the underside of the coverlet, strips of Velcro 16 may be attached to mate with other strips of velcro 17 attached to a foam layer 15. This construction permits the foam layer to be readily removed so that the coverlet may be washed. Also, the foam may tend to degrade before the coverlet wears out so that a new piece of foam may be adhered to the coverlet without replacing the whole coverlet.

A sandwich construction having three layers may preferably be constructed wherein the top and bottom layers are of hollow polyester fiber, either loose fibers or fiber batts, quilted to external ticking with a central pocket to receive a foam slab. The edges of the upper and lower layer may be stitched together except along one edge which may be fitted with a zipper to allow the foam to be removed so that the coverlet could be laundered or so that the foam pad could be readily replaced when it becomes worn or deteriorates.

Such a sandwich construction with an available central pocket is advantageous from a manufacturing standpoint inasmuch as a coverlet with two layers of hollow fibers may be constructed and shipped without the central foam pad, thus greatly reducing the shipping bulk of the coverlet. Also, the pocket permits customers to purchase separately a foam pad for insertion into the pocket. Some customizing by a customer is thereby permitted inasmuch as some customers may prefer a thinner or thicker foam pad. The foam pad may be held in place by Velcro strips, as illustrated in FIG. 5, except that the foam pad would be sandwiched between a pair of quilted hollow fiber layers joined at the edges, with one edge preferably having a zipper closure rather than permanent stitching. The three-layer structure also makes the cover reversible, i.e., the bottom and top layers may be quilted to an outer decorative fabric so that the coverlet may be turned over periodically to prevent undue wear on only one outer surface.

While other coverlets have been suggested in the art to provide effective insulating media between a sleeper and the large body of water contained in a conventional unheated waterbed mattress, the instant invention provides such a construction without undue bulk or complex multi-layer construction. To achieve a similar effect by substitution of regular solid polyester fibers, e.g., Dacron fibers, in place of the hollow fibers of the instant invention, e.g., Hollofil fibers, a layer of solid fibers would have to be about twice the thickness to achieve a K factor equivalent to a thinner layer of hollow fibers. Thus, a coverlet made with conventional long, solid polyester fibers would have such a bulk and thickness that the comfort of a waterbed may be substantially diminished. Furthermore, the use of conventional solid fibers in such bulk provides a very difficult construction to quilt. Thus, an advantage of the instant invention is that it may be readily quilted to form a construction having a top fabric layer, a hollow fiber body, optionally another insulating medium such as a foam layer or a heat shield, and a bottom fabric layer.

Other insulating materials such as wool, down (feathers) and the like have certain deficiencies for the purposes of this invention. Loose wool tends to "bunch" together and is relatively heavy for such purposes. While down, especially goose down, is an excellent lightweight insulator for sleeping bags, parkas and the like, it tends to compress greatly when subjected to a load. Thus down is not an effective insulator for use under a sleeper.

Regular polyester fabrics, e.g., non-hollow fibers may be used in the instant invention, however, the thickness and bulk of such fibers in comparison with hollow polyester fibers is significantly greater. Thus, for the purpose of the instant invention, hollow polyester fibers are greatly preferred.

The coverlets of the instant invention may, of course, be utilized with conventional innerspring mattresses to provide warmth and comfort. While sheepskin, convoluted foam and the like are being used with regular innerspring mattresses, the coverlets of the instant invention have the various advantages elucidated in the above description.

We claim:

1. A thermal insulating layered cover especially adapted to fit a filled waterbed bladder comprising a bladder cover for a large conventional waterbed bladder consisting essentially of:

a rectangular flexible lightweight foam pad underlay having a minimal thickness of at least about one-fourth inch and a maximum thickness of about one inch;

a rectangular layer of hollow, polyester insulating fibers having a minimum thickness of at least three-eights inch and a maximum thickness of about two inches, said layer of fibers superposed upon said foam pad;

a fabric overlay attached to said layer of insulating fibers to form an upper surface for the cover; and loop-like bladder attachment means attached near each corner of said cover to secure said cover to said bladder, and said layer of insulating fibers quilted to said foam pad and to said fabric overlay to form an integral, sandwich-type unit, said integral unit having an over-all thickness of at least about three-quarter inch and a maximum thickness of about three and one-half inches, said cover sized to fit the upper surface of a large conventional waterbed bladder.

2. The bladder cover of claim 1 wherein said integral unit has an underlay of fabric.

3. The bladder cover of claim 1 wherein an intermediate sheet-like material is interposed between said insulating fabric layer and said foam layer.

4. The bladder cover of claim 1 wherein said foam layer is sandwiched between an upper and lower layer of insulating fiber.

5. The bladder cover of claim 4 wherein decorative fabric overlays cover the upper and lower surfaces of the sandwich construction.

6. The bladder cover of claim 4 wherein said foam layer is removable.

7. The bladder cover of claim 6 wherein said upper and lower layer of insulating fiber are joined along the edge by quick-opening means.

* * * * *